United States Patent [19]

Smith et al.

[11] 4,111,472

[45] Sep. 5, 1978

[54] TAMPER-PROOF EMERGENCY EXIT WINDOW GRATE

[76] Inventors: Loring E. Smith, 37 Hadley Rd., Sudbury, Mass. 01776; Mario J. Aloisi, 843 Chandler St., Tewksbury, Mass. 01876

[21] Appl. No.: 794,715

[22] Filed: May 9, 1977

[51] Int. Cl.[2] ..... E05C 15/02; E05C 1/06

[52] U.S. Cl. ..... 292/92; 49/56; 49/141; 292/188

[58] Field of Search ..... 70/54, 55, 56; 292/92, 292/134, 183, 184, 185, 186, 187, 188, 143, 173; 49/53, 56, 57, 141, 394, 395

[56] References Cited

U.S. PATENT DOCUMENTS

| | | | |
|---|---|---|---|
| 69,236 | 9/1867 | Miller et al. | 49/56 |
| 250,592 | 12/1881 | Smith | 49/56 |
| 1,436,892 | 11/1922 | Morse et al. | 292/188 |
| 1,670,430 | 5/1928 | Alexander | 292/143 |
| 1,801,284 | 4/1931 | McNulty | 292/184 |
| 2,031,725 | 2/1936 | Mellor | 292/173 |
| 2,641,494 | 6/1953 | Burris | 292/189 |
| 2,789,849 | 4/1957 | Hughes | 292/189 X |
| 3,724,130 | 4/1973 | Bogue | 292/52 X |
| 3,921,334 | 11/1975 | Black | 49/141 X |
| 3,953,939 | 5/1976 | Klein | 49/56 |
| 4,033,156 | 7/1977 | Cottingham | 70/56 |

*Primary Examiner*—Thomas J. Holko
*Attorney, Agent, or Firm*—Joseph Zallen

[57] ABSTRACT

A locking mechanized enclosure is mounted at the edge of a hinged window grate so that its interior side wall and front wall are inaccessible from the outside and all of its exposed walls are solid. A locking member extends into the enclosure from the window frame in back of vertical blocking member within the enclosure. The blocking member can be raised by depressing a pivoted plate. However, access to the plate is only through a door in the enclosure which can be opened only from inside the grate.

7 Claims, 9 Drawing Figures

TAMPER-PROOF EMERGENCY EXIT WINDOW GRATE

BACKGROUND OF INVENTION

This invention relates to emergency exits. In particular it relates to emergency exits through doors and windows in the case of fire and the like.

Devices have been described in the prior art which provide emergency exits through doors, as for example U.S. Pat. Nos. 2,494,672; 2,528,954; 2,616,132 and 3,724,130. Where the doors are solid such mechanisms normally are sufficient to prevent tampering and unauthorized opening or forcing from the outside. However, in the case of windows and in particular steel grates over windows, the prior art devices as exemplified by U.S. Pat. Nos. 69,236; 2,924,862; 3,921,334 and 3,953,939, while operable as emergency exits, are subject to being opened or forced open from the outside and thus do not provide sufficient security.

One object of the present invention is to provide a novel, tamper-proof, emergency release lock opening mechanism.

A further object of this invention is to provide a window grate or the like having a tamper-proof emergency release lock mechanism which can only be operated from the inside and is not accessible to attempted entry from the outside.

Other objects and advantages of this invention will be apparent from the description and claims which follow taken together with the appended drawings.

SUMMARY OF INVENTION

The invention comprises generally a novel, emergency release locking mechanism and a tamper-proof emergency door or grate containing such mechanism.

The mechanism comprises an enclosure having its top, bottom, back and side walls solid. The enclosure has a front opening slot or a slot opening to the front and one side. It has a front door or access to the interior of the enclosure. Within the enclosure is a vertically movable blocking member. A locking member extends into the slot from the door or window frame. The blocking member is normally down so as to prevent removal or unlocking of the locking member. The enclosure is mounted on the door, window or grate which cannot be swung open because the vertical blocking member is pressing against the front of the locking member.

Means are provided for raising the vertical blocking member above the locking member so that the enclosure is now free to move outward and thus permit the door, window or grate to be opened. One outward thrust will release the locking member and cause the grate to swing outwardly.

The vertical blocking member raising mechanism preferably comprises a plate pivotally connected to a side wall of the enclosure and also pivotally connected to the vertical blocking member. Pressure on the plate below the pivot point causes the blocking member to be raised while gravity causes its downward return upon release of the plate. The blocking member can be a channel member with an upper guide wherein the guide is connected to one side wall. The vertical locking member can also be a channel plate extending between the two side walls wherein the plate is U-shaped with its side portions pivotally connected to the side walls and the vertical blocking member.

The access door to the interior of the enclosure preferable has a spring return means so that the access door is normally closed. The door also preferably has a stop to prevent motion of the blocking member when the door is closed.

Where the grate is expanded metal it is difficult to unlock the mechanism with a picking tool from outside the grate. The ability to withstand tampering is also enhanced by making the enclosure and its components out of a heavy, strong metal.

SPECIFIC EXAMPLES OF INVENTION

Figure 1:
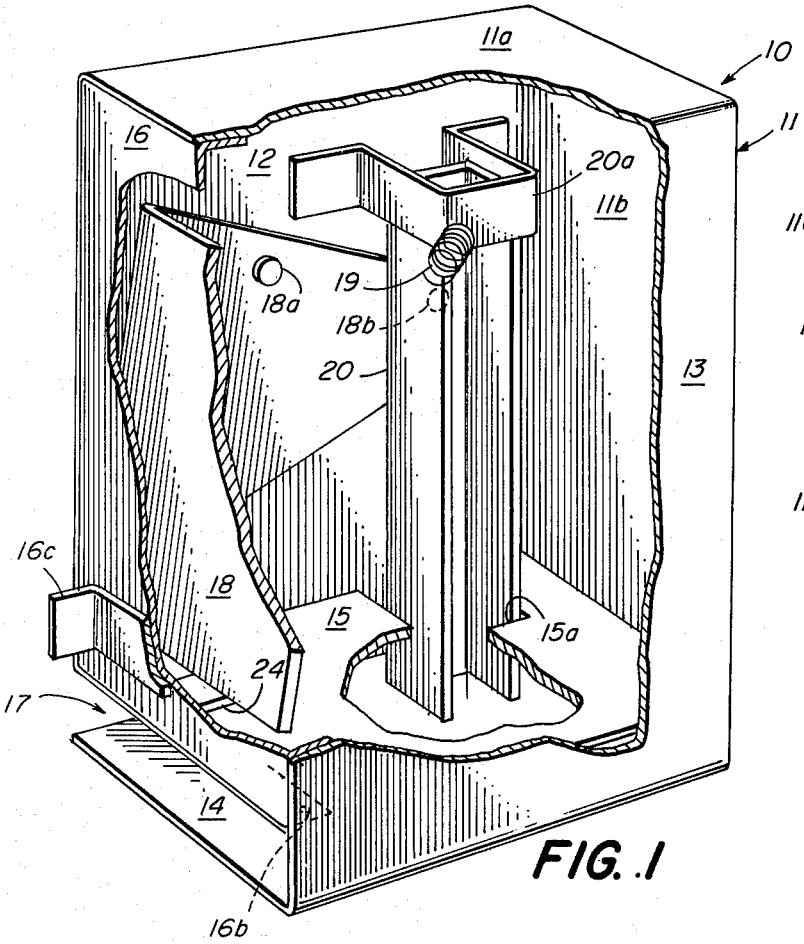
FIG. 1 is a perspective view with partial cutaway of one embodiment of the enclosure and locking mechanism of this invention.

Referring now to FIGS. 1 to 5, there is illustrated therein an enclosed locking device 10 made in accordance with this invention. The device comprises an enclosure 11 having a top wall 11*a*, a back wall 11*b*, a left side wall 12 and a right side wall 13, as well as a bottom wall 14 and an access door 16 which comprises the front wall. There is also a second, inner bottom wall 15 having a slot 15*a* in which the vertical blocking member 20 is movable. Walls 14 and 15 form a slot 17 in which transverse locking member 23 extends from the door or window frame 22. Access door 16 has a stop 24.

Within the enclosure 11 is a guide 20*a* for the vertical blocking member 20. Vertical blocking member 20 is pivotally attached by pivot 18*b* to the side wall of actuating plate 18. Plate 18 is also pivotally attached by pivot 18*a* to the side wall 12 of the enclosure. A spring 19 is provided between the guide 20*a* and the access door. Stop 24 engages plate 18.

Figure 3:
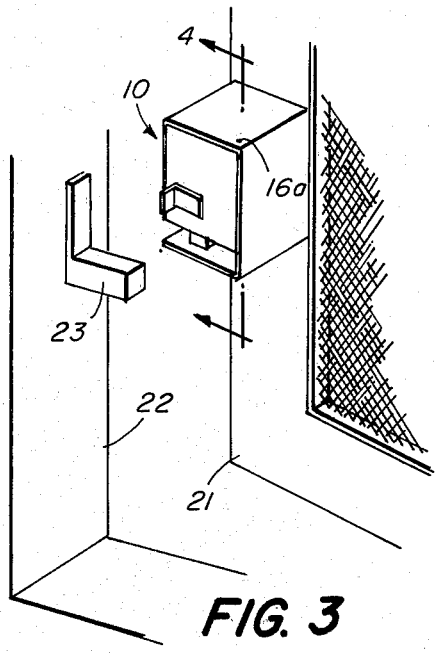
FIG. 3 is an enlarged view of FIG. 2 wherein the grate is partially opened.
Figure 2:
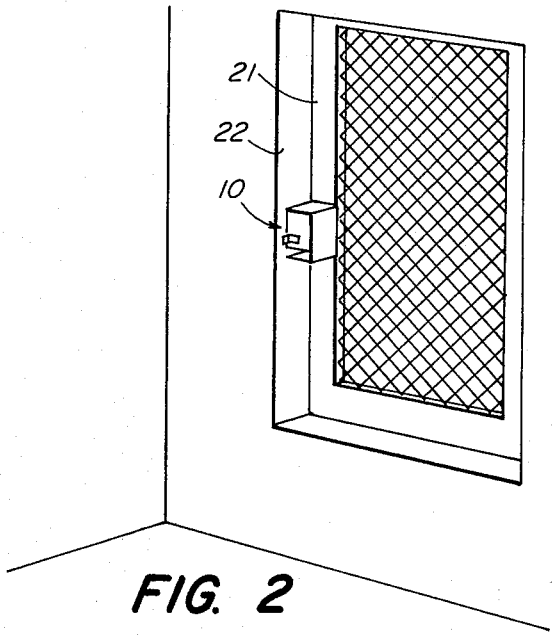
FIG. 2 is a perspective view of the positioning of the device of FIG. 1 on a hinged window grate.
Figure 5:
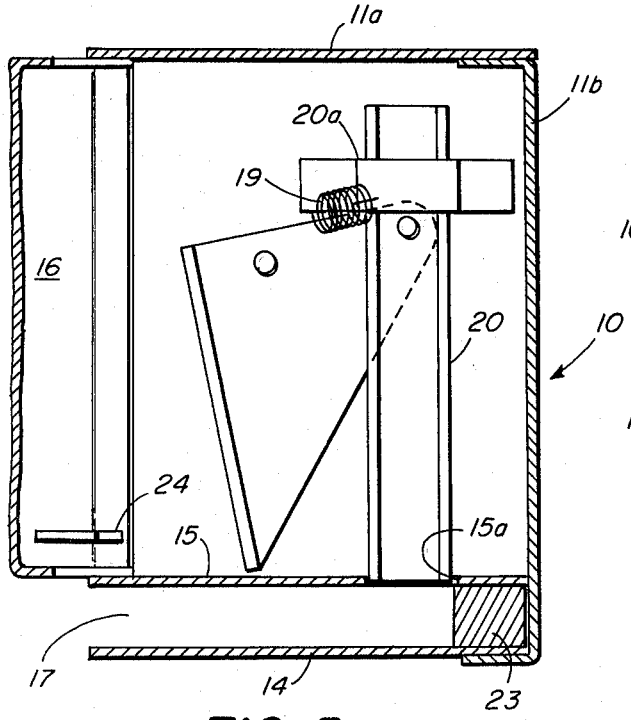
FIG. 5 is a view as in FIG. 4 showing unblocked condition.
Figure 4:
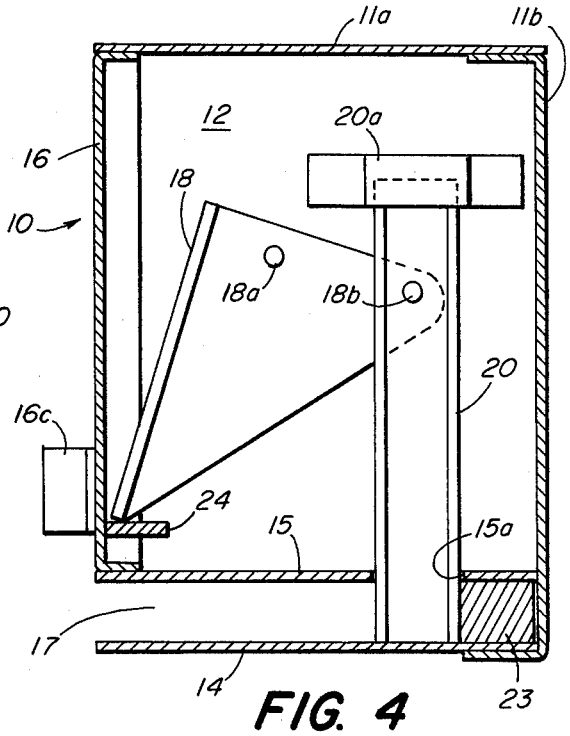
FIG. 4 is a vertical section of the device in position on a door showing blocking condition.

When the access door 16 is opened by means of handle 16*c*, the face of plate 18 is exposed. Pressing on the face of plate 18 causes the vertical blocking member 20 t0 rise and permit the enclosure to be slid over and away from transverse locking member 23. As shown in FIGS. 2 and 3, the device mounted on grate 21 is positioned in such a way that the access door cannot be reached from the outside.

Figure 7:
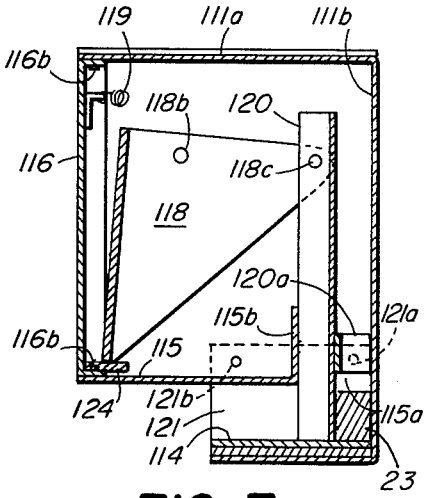
FIG. 7 is a vertical section along lines 7—7 of FIG. 6.
Figure 6:
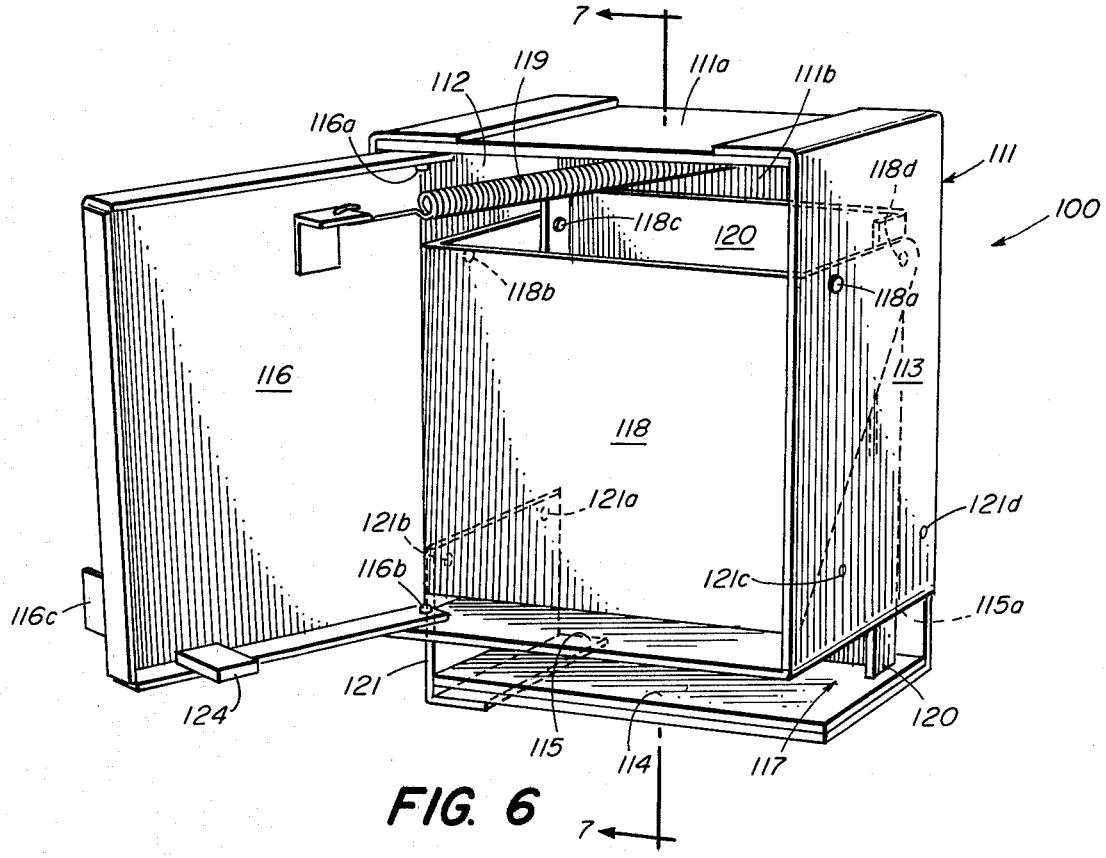
FIG. 6 is another embodiment of this invention.

The embodiment illustrated in FIGS. 6 and 7 is similar in general construction to that illustrated in FIGS. 1 to 5 except that its slot extends across the entire bottom and the raising mechanism and vertical blocking member are pivotally connected to both side walls.

This second embodiment 100 has an enclosure 111 comprising an upper wall 111*a*, a back wall 111*b*,, side walls 112 and 113, outer bottom wall 114 and inner bottom wall 115 defining slot 117. A plate 121 is attached to the exposed side wall by screws through orifices 121*a* and 121*b* or 121*c* and 121*d* so that the exposed side wall, depending on what side wall it is mounted, will be solid as is side wall 13 in the embodiment of FIGS. 1 to 5.

Opening the front access door 116 which normally is kept closed by spring 119 reveals actuating plate 118 having side portions pivotally connected to pivots 118*a* and 118*b* on side walls 113 and 112 respectively, and pivots 118*a* and 118*c* on the side portions of vertically moving blocking member 120. Pushing of plate 118 causes the vertical blocking member 120 to rise through orifice 115*a* an inner bottom plate 115 and thus permits the device 100 to be moved over the transverse locking member 23. Cover plate 121 preferably extends the full width of the side wall 112 to which it is attached so as to adequately protect access where the bottom wall 114 is not as deep, as illustrated in FIG. 7. A guide for vertical blocking member 120 is preferable and in this case is provided by having the inner bottom wall 115 bent upwards to form a flange 115*b*. When the door 116 is open, simple pressue against plate 118 elevates the blocking member 120 to permit the enclosure to move over the locking member 23. However, when the door 116 is closed, the bottom stop 124 extending beneath the edge of plate 118 prevents anyone from moving the plate by any picking tool while the access door 116 is closed or slightly ajar.

Figure 9:
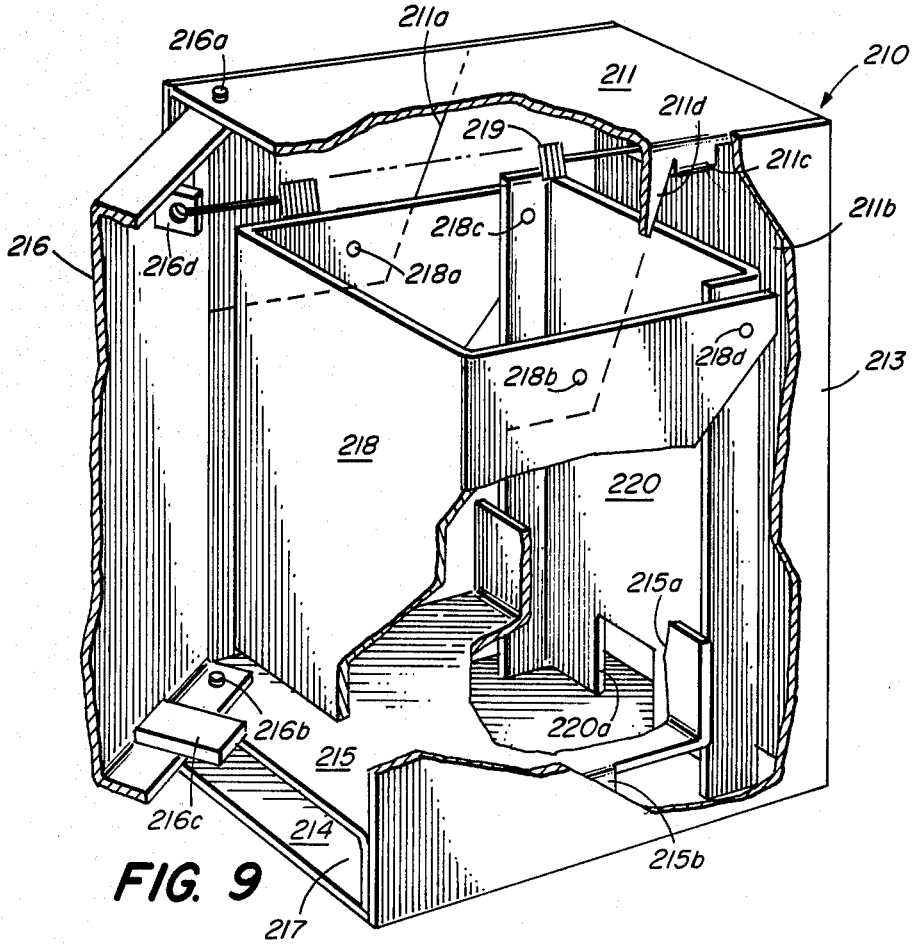
FIG. 9 is an enlarged view of FIG. 8 with partial cutaway.
Figure 8:
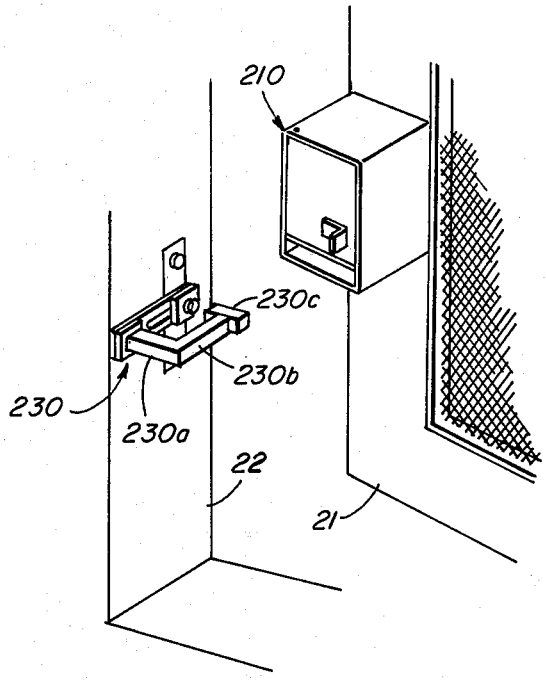
FIG. 8 is a perspective view as in FIG. 2 of another form of this invention.

A third embodiment of this invention illustrated in FIGS. 8 and 9 employs the same general principle as heretofore described. However, instead of having a slot which opens to the front and to the side, the illustrated embodiment has a slot which opens only to the front and has a different locking member. Thus, the enclosed locking device 210 comprises an enclosure 211 having solid side, top and back walls, including right side wall 213 as well as a bottom solid wall 214 and a second, inner wall 215. An access door 216, which comprises the front wall, covers the space between the inner bottom wall 215 and the top wall 211*a*, thus leaving the slot 217 formed by the bottom walls 214 and 215. The access door 216 has a connection 216*d* for a spring 219 which is connected to another wall of the enclosure and the door 216 pivots on pins 216*a* and 216*b*. Access door 216 also has a bottom, inwardly extending tab stop 216*c*.

Inner bottom wall 215 extends towards the back wall 211*b*, but its ends are spaced away from that back wall to form an opening in which vertical blocking member 220 can move. Vertical blocking member 220 is pivotally connected by pins 218*c* and 218*d* to actuating plate 218. Plate 218 is pivotally mounted on side walls 212 and 213 by pins 218*a* and 218*b* so that pressure against the forward portion of plate 218 will lift the blocking member 220. When the access door 216 is closed, the tab stop 216*c* prevents the pivoting of plate 218 and thus acts as a restraint.

In this embodiment, the locking member 230 has a base portion 230*a* extending out from the wall and then a locking portion 230*b* perpendicular to segment 230*a* and having transverse end portion 230*c*. When the mechanism 210 engages the locking member 230, segments 230*b* and 230*c* extend into slot 217. When the blocking member 220 is raised, the transverse end or head portion 220*c* abuts the back wall 211*b*. The blocking member 220 has a notch 228 which fits over segment 230*b*. Thus, when the blocking member 220 comes down, the head portion 230*c* is held between the blocking member 220 and the back wall 211*b*, locking members 230 and 220 together.

We claim:

1. A tamper-proof, hinged, emergency exit panel adapted to be mounted in an opening of a building and comprising:

(a) a locking enclosure mounted adjacent the edge of the panel and characterized in that all of its walls which do not face the building are solid, that it has an inner facing slot opening into its interior and that it has an access door covering its inner face;

(b) a vertical blocking member spaced within said enclosure;

(c) means spaced within said enclosure for elevating said blocking member and comprising a hand-actuable plate pivotally connected to a side wall of the enclosure and to said vertical blocking member;

(d) a locking member adapted to extend from the building through said slot and being lockable in said enclosure by said vertical locking member;

said panel being so characterized that pressure on said plate below the pivot point elevates said blocking member to permit said panel to be readily swung open over said locking member by virtue of said slot.

2. Claim 1 wherein the panel is a grate.

3. Claim 1 wherein said slot is below said door and extends across an interior face of said enclosure; all the other walls of said enclosure being solid, said locking member having a portion extending into said slot so as to be engagable with said vertical blocking member.

4. Claim 1 wherein said slot is in a side wall and said locking member has a portion extending into said slot.

5. A tamper-proof, emergency release device adapted for attachment to a hinged emergency exit panel and comprising an enclosure having one solid side wall, solid back, top and bottom walls, an access door in the front wall and a slot extending either along one otherwise solid side wall or along the front wall; said enclosure containing a vertically movable blocking member and means for elevating said blocking member which comprises a hand-actuable plate pivotally connected to a side wall of the enclosure and to said vertical blocking member so that pressure on said plate raises said blocking member, said slot being adapted to permit a locking member from the frame in which the panel is positioned to extend behind said blocking member so as to prevent swinging open of the panel, said device being characterized in that elevation of said blocking member by said means permits said device to move over said locking member and permit the panel to swing open.

6. A tamper-proof, hinged, emergency exit panel adapted to be mounted in an opening of a building and comprising:

(a) a locking enclosure mounted adjacent the edge of the panel and characterized in that all of its walls which do not face the building are solid, that it has an inner, facing slot opening into its interior and that it has an access door covering its inner face;

(b) a vertical blocking member spaced within said enclosure;

(c) means spaced within said enclosure for elevating said blocking member;

(d) a locking member adapted to extend from the building through said slot and being lockable in said enclosure by said vertical blocking member;

said panel being further characterized in that by opening said access door and elevating said blocking member, it is readily swung open over said locking member by virtue of said slot; said access door having an interior protuberance which acts to prevent operation of said elevating means unless said access door is open.

7. A tamper-proof, emergency release device adapted for attachment to a hinged emergency exit panel and comprising an enclosure having one solid side wall, solid back, top and bottom walls, an access door in the front wall and a slot extending either along one otherwise solid side wall or along the front wall; said enclosure containing a vertically movable blocking member and means for elevating said blocking member, said slot being adapted to permit a locking member from the frame in which the panel is positioned to extend behind said blocking member so as to prevent swinging open of the panel, said device being characterized in that elevation of said blocking member by said means permits said device to move over said locking member and permit the panel to swing open, said access door having an interior protuberance which acts to prevent actuation of said elevating means unless said access door is open.

* * * * *